US009291932B2

(12) United States Patent
Itoh

(10) Patent No.: US 9,291,932 B2
(45) Date of Patent: Mar. 22, 2016

(54) IMAGE FORMING APPARATUS HAVING MISREGISTRATION CORRECTION

(71) Applicant: CANON KABUSHIKI KAISHA, Tokyo (JP)

(72) Inventor: Masatoshi Itoh, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/679,088

(22) Filed: Nov. 16, 2012

(65) Prior Publication Data

US 2013/0142549 A1 Jun. 6, 2013

(30) Foreign Application Priority Data

Dec. 1, 2011 (JP) ..... 2011-263536
Sep. 20, 2012 (JP) ..... 2012-207123

(51) Int. Cl.
*G03G 15/01* (2006.01)
*G03G 15/00* (2006.01)

(52) U.S. Cl.
CPC ..... *G03G 15/01* (2013.01); *G03G 15/0189* (2013.01); *G03G 15/5058* (2013.01); *G03G 2215/0158* (2013.01)

(58) Field of Classification Search
CPC ..... G03G 2215/0161; G03G 2215/0158
See application file for complete search history.

(56) References Cited

U.S. PATENT DOCUMENTS 4,912,491 A * 3/1990 Hoshino ..... G03G 15/0194 347/116
5,970,295 A * 10/1999 Samizo ..... G03G 15/231 399/302
2008/0069603 A1* 3/2008 Nakatsu ..... G03G 15/0194 399/301
2008/0174834 A1* 7/2008 Ueda ..... G03G 15/01 358/488
2008/0273902 A1* 11/2008 Maeda ..... G03G 15/5058 399/301
2009/0214236 A1* 8/2009 Takane ..... G03G 15/011 399/39
2011/0103818 A1 5/2011 Itoh

FOREIGN PATENT DOCUMENTS

JP 2000-218860 A 8/2000
JP 2003-207976 A 7/2003
JP 2005-234099 A 9/2005

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus includes a plurality of image forming devices having a developing device that develops an electrostatic latent image formed on an image bearing member to form a toner image, and a transferring device that transfers the developed toner image to an intermediate transfer member or a transfer material, for each of a plurality of colors, an exposure unit that irradiates the image bearing member with a laser beam to form the electrostatic latent image on the image bearing member, and a detector that detects an image pattern for correcting misregistration of each color. In addition, a control device corrects the misregistration of each color based on a detection result by the detector. The control device forms an image pattern of one color among the plurality of colors on a first page interval that is between a first image and a second image, and corrects misregistration based on a first period from a timing when a reference signal to form the image pattern of one color among the plurality of colors is transmitted to a timing when the image pattern of one color among the plurality of colors is detected by the detector.

7 Claims, 10 Drawing Sheets

| FIG. 3A |
| --- |
| FIG. 3B |

| FIG. 6A |
| --- |
| FIG. 6B |

IMAGE FORMING APPARATUS HAVING MISREGISTRATION CORRECTION

BACKGROUND OF THE INVENTION

1. Field of the Invention

The present invention relates to electronic photography color image forming apparatuses, such as a laser printer, a copier and a facsimile, which include a plurality of photosensitive members.

2. Description of the Related Art

In an image forming apparatus that overlaps multi-color toner images with each other to form a color image, it is important that each color is correctly printed on a prescribed position on a printed matter, i.e., misregistration does not occur in view of quality of products. Hereinafter, "misregistration" is defined as misregistration regarding colors. There may be various factors of misregistration. Among major factors of adverse effects, there is a factor of variation in laser irradiation position on a photosensitive member caused according to thermal deformation of an optical unit. Typically, the optical unit has a configuration that causes a rotating polygon mirror to reflect a laser beam emitted from a light source for scanning. While the laser beam reaches from the light source to a photosensitive member, the beam is reflected by mirrors several times and the traveling direction thereof is changed, and a spot and a scanning width are adjusted via lenses. These elements defining the optical path of the laser beam are fixed to a frame configuring an optical unit. Rise in temperature due to operation of the image forming apparatus thermally deforms the frame, and thus changes the orientations of these elements, thereby affecting the direction of the optical path of the laser beam. Variation in direction of the optical path is increased in proportion to the optical path length reaching the photosensitive member. Accordingly, even if frame deformation is significantly small, variation in laser irradiation position appears. Such variation in laser irradiation position according to a phenomenon of rise in temperature is called a thermal shift of the laser irradiation position. Rise in temperature in an image forming apparatus and rise in temperature of an optical unit due to heating of a motor driving a rotating polygon mirror (self-temperature rise) have been recognized as factors varying the laser irradiation position.

There are following methods for correcting misregistration caused by these factors. For instance, pattern image for matching laser irradiation timing of each color is formed as a toner image on an intermediate transfer medium, and the image is read by a sensor. Accordingly, this method detects the amount of misregistration between a reference color and an object color and corrects an image-writing position. However, this method takes required time for calibration to form a pattern image. A method to address this problem provides a temperature sensor, a misregistration correction section that estimates variation in laser irradiation position based on an output of the temperature sensor to correct laser irradiation timing, and corrects the misregistration without forming a pattern image. Typical configurations are as follows. For instance, one method detects temperature of an optical unit itself by a temperature sensor, and corrects a laser irradiation position by a correction control device (e.g., see Japanese Patent Application Laid-Open No. 2000-218860). Another method detects temperature in an apparatus by a temperature sensor, and corrects a laser irradiation position by a correction control device based on a detection result (e.g., see Japanese Patent Applications Laid-Open No. 2003-207976 and No. 2005-234099). These methods are based on a technical idea that measures temperature at a site affecting a thermal shift, and corrects the laser irradiation position according to variation in temperature. These methods are applicable to cases where variation in temperature and misregistration tendency can be approximated at one-to-one correspondence relationship.

However, in actual products, one-to-one correspondence relationship is not necessarily found in relationships between variation in temperature and tendency of variation in color misregistration. Misregistration correction by estimating variation in laser irradiation position based on a result of measurement of temperature is inapplicable to these cases. More specifically, an example thereof is a case where, even though temperature at a site affecting a thermal shift is increasing, the direction of misregistration variation is reversed in the process. In such a case, it can be considered that relative temperature balance at multiple points complexly deforms an optical unit, which, in turn, varies laser irradiation position. However, it is difficult to identify these points.

For instance, in an image forming apparatus having a configuration where optical units capable of scanning only one laser beam are dedicatedly provided for respective colors, variation in temperature and variation in laser irradiation position can be easily approximated at one-to-one relationship. The optical units for the respective colors have the same configuration. Accordingly, thermal shifts of laser irradiation positions have similar tendencies among all the colors, and a relative difference between colors can be easily found. However, in an image forming apparatus having a configuration where one optical unit can scan multiple laser beams for realizing reduction in size and cost of the image forming apparatus, the optical unit has a complicated structure. For instance, the numbers and shapes of mirrors and lenses where laser beams pass in processes from light sources to the surfaces of photosensitive members are different according to colors. Furthermore, a site and a peripheral structure where these optical elements are fixed to the optical unit are different. According to these causes, variations in laser irradiation position due to variations in temperature sometimes have different tendency among the colors. In an aspect, according to increase in unit packaging density in the apparatus due to reduction in size, thermal effects on the optical unit affected from the periphery become complicated. Owing to the effects of these factors, it is difficult to find correlation between tendency of variation in misregistration and variation in temperature around the optical unit. That is, there is a possibility that variation in laser irradiation position according to variation in temperature cannot be estimated.

To address the problems, a method can be considered that forms a pattern image of a toner image on an intermediate transfer medium between pages in continuous prints, detects the amount of misregistration between a reference color and an object color by reading the image, and corrects the image-writing position. However, if a multi-color toner image is formed between pages, a sufficient number of pattern images cannot be accommodated in prescribed page intervals. There is a method that widens page intervals for forming multiple (multi-color) toner images between pages and performs calibration. This method unfortunately decreases throughput.

SUMMARY OF THE INVENTION

An object of the present invention is to solve at least one of these and other problems.

Another object of the present invention is to form a pattern image for correcting misregistration between pages without widening page intervals, performs a misregistration correction process, and reduces misregistration caused by variation in laser irradiation position due to variation in temperature. A further object of the present invention is to provide an image forming apparatus, including a plurality of image forming devices including a developing device that develops an electrostatic latent image formed on an image bearing member to form a toner image, and a transferring device that transfers the toner image developed by the developing device onto any of a conveyance member and a transfer material on the conveyance member, for each of a plurality of colors, an exposure unit irradiating the image bearing member with a laser beam to form the electrostatic latent image on the image bearing member, a detector detecting a toner image for detection that is a toner image for detecting a positional deviation of each color transferred onto the conveyance member by the transferring device, and a control device detecting and correcting the positional deviation of each color based on a detection result of the toner image for detection detected by the detector, wherein the control device allows one of said plurality of image forming devices to form a toner image for detection with one color between pages in a print job including plural pages of images, and corrects timing at which the exposure unit emits the laser beam based on a time between timing pertaining to start of forming the toner image for detection and timing on which the detector detects the toner image for detection.

A still further object of the present invention is to provide an image forming apparatus including a plurality of image forming devices that includes a developing device developing an electrostatic latent image formed on an image bearing member to form a toner image, and a transferring device transferring the toner image developed by the developing device onto any of a conveyance member and a transfer material on the conveyance member, for a plurality of colors, an exposure unit that irradiates the image bearing member with a laser beam to form an electrostatic latent image on the image bearing member, a detector that detects a toner image for detection that is a toner image for detecting a positional deviation of each color transferred onto the conveyance member by the transferring device, and a control device that detects and corrects the positional deviation of each color based on a detection result of the toner image for detection detected by the detector, wherein the control device causes the image forming devices to form the toner image for detection, and corrects timing at which the exposure unit emits the laser beam based on a time between timing pertaining to start of forming the toner image for detection and timing on which the detector detects the toner image for detection.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiment 1

Configuration of Image Forming Apparatus

Figure 1A:
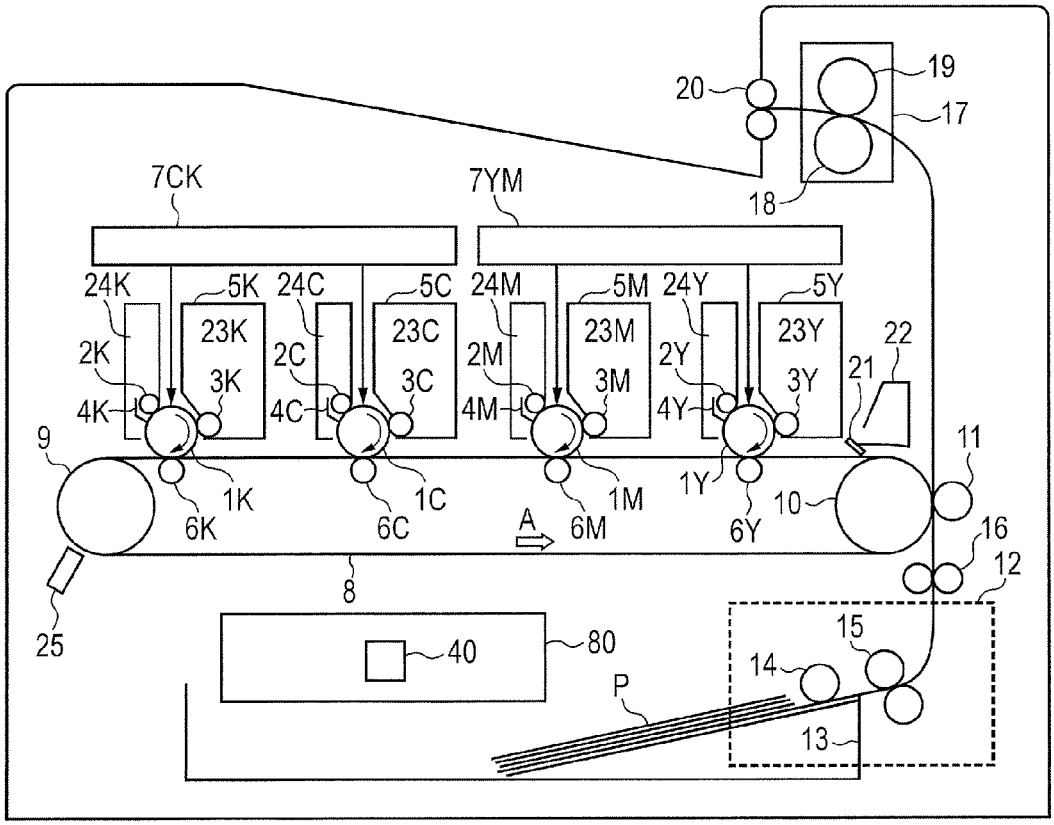
FIG. 1A is a schematic diagram of an image forming apparatus of Embodiments 1 to 3.

A color image forming apparatus (hereinafter, called a main body) illustrated in FIG. 1A includes process cartridges 5Y, 5M, 5C and 5K detachably attached to a main body. These four process cartridges 5Y, 5M, 5C and 5K have the same configuration, but are different in color, i.e., in forming images of yellow (Y), magenta (M), cyan (C) and black (K) toner. Hereinafter, except for description on a specific color, symbols of Y, M, C and K are omitted. A process cartridge 5 includes a toner container 23, a photosensitive drum 1 that is an image bearing member, a charging roller 2, a developing roller 3, a drum cleaning blade 4 and a waste toner container 24. Laser units 7YM and 7CK (exposure unit) are arranged above the process cartridge 5. The laser unit 7YM performs exposure based on an image signal onto photosensitive drums 1Y and 1M. The laser unit 7CK performs exposure based on an image signal onto photosensitive drums 1C and 1K. This embodiment has the configuration where one laser unit 7 irradiates two photosensitive drums 1 with laser beams to form electrostatic latent images. However, the configuration may be adopted where the laser unit 7 irradiates at least one photosensitive drum 1 with a laser beam. After the photosensitive drum 1 is charged to a prescribed negative potential by the charging roller 2, the laser unit 7 forms each electrostatic latent image. The electrostatic latent image is reversely developed by the developing roller 3, negative toner adheres, and Y, M, C and K toner images are formed.

The intermediate transfer belt unit includes an intermediate transfer belt 8, a drive roller 9 and a secondary transfer opposed roller 10. A primary transfer roller 6 is provided in an intermediate transfer belt 8 in a manner opposite to each photosensitive drum 1, and a transfer voltage is applied by a voltage applying section, such as a power source (not illustrated). Each photosensitive drum 1 is rotated in a direction of an arrow, and the intermediate transfer belt 8 is rotated in the direction of an arrow A. Application of a positive voltage by a voltage applying section, such as a power source (not illustrated), to the primary transfer rollers 6 causes toner images formed on photosensitive drums 1Y (on the image bearing member) to be transferred onto the intermediate transfer belt 8 (onto the conveyance member) sequentially starting from the image on the drum 1Y (called primary transfer). The toner images are conveyed to a secondary transfer roller 11 in a state where four toner images overlap with each other on the intermediate transfer belt 8.

A feeding and conveying device 12 includes a feed roller 14 that feeds a transfer material P from a sheet cassette 13 storing the transfer materials P, and a pair of conveyance rollers 15 that convey the fed transfer material P. The transfer material P conveyed from the feeding and conveying device 12 is, in turn, conveyed by the pair of registration rollers 16 to the secondary transfer roller 11. As to transfer from the intermediate transfer belt 8 onto the transfer material P, application of a positive voltage by a voltage applying section, such as a power source (not illustrated), to the secondary transfer roller 11 causes four color toner images on the intermediate transfer belt 8 to be transferred onto the conveyed transfer material P (called secondary transfer). The transfer material P after transfer of the toner images is conveyed to a fixing device 17. Heat and pressure are applied by a fixing film 18 and a pressure roller 19 to the sheet, and the toner image is fixed on the surface. The fixed transfer material P is discharged by a pair of discharge rollers 20. Meanwhile, toner remaining on the surfaces of the photosensitive drums after transfer of the toner images is removed by the cleaning blades 4. The removed toner is collected into the waste toner container 24. Toner remaining on the intermediate transfer belt 8 after the secondary transfer onto the transfer material P is removed by a transfer belt cleaning blade 21. The removed toner is collected into a waste toner collection bin 22.

A misregistration detection sensor 25 causes a light source to irradiate a misregistration detection image pattern (hereinafter, simply called the misregistration detection pattern) formed on the intermediate transfer belt 8, and causes a light-receiving sensor to read reflected light. The misregistration detection sensor 25 electrically processes temporal variation in intensity of the light-receiving sensor when the misregistration detection pattern passes, as positional deviation information. For instance, two misregistration detection sensors 25 are opposed to the intermediate transfer belt 8 laterally in a main scanning direction. The main scanning direction is a direction orthogonal to a conveyance direction of the intermediate transfer belt 8.

A control board 80 is embedded with electric circuits for controlling the main body. The control board is embedded with a CPU 40. The CPU 40 integrally controls operations of the main body, such as control on a drive source (not illustrated) for conveying the transfer material P, control on a drive source (not illustrated) of the process cartridge 5, control related to image formation, and control related to failure detection. The CPU 40 also controls an after-mentioned misregistration correction process, and formation of the misregistration detection pattern for executing a misregistration correction process.

[Configuration of Misregistration Detection Sensor]

Figure 1B:
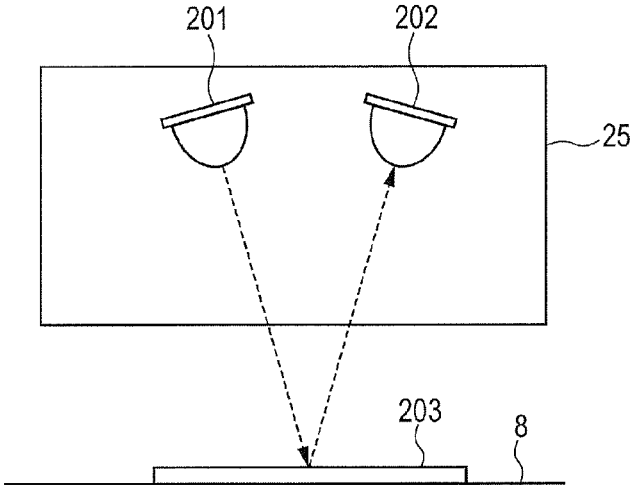
FIG. 1B is a schematic diagram of a misregistration detection sensor.

The configuration of the misregistration detection sensor 25 used for detecting misregistration will be described. As illustrated in FIG. 1B, the misregistration detection sensor 25 includes a light emitting element 201, such as LED, and a light receiving element 202, such as a phototransistor. The misregistration detection sensor 25 irradiates the misregistration detection pattern 203 (toner image for detection) on the intermediate transfer belt 8 with infrared light from the light emitting element 201. The misregistration detection sensor 25 causes the light receiving element 202 to receive positively reflected light therefrom, and outputs a signal to the CPU 40 (see "misregistration detection sensor output" in FIG. 2B). The CPU 40 causes the misregistration detection sensor 25 to detect the position of the misregistration detection pattern 203 based on an output signal from the misregistration detection sensor 25, which is a result of detecting the misregistration detection pattern 203. It is assumed that the conveyance speed of the intermediate transfer belt 8 is constant (e.g., 135 mm/s); the CPU 40 detects the position of the misregistration detection pattern 203 as time. This assumption is analogous in another embodiment.

[Arrangement of Misregistration Detection Pattern]

Figure 2A:
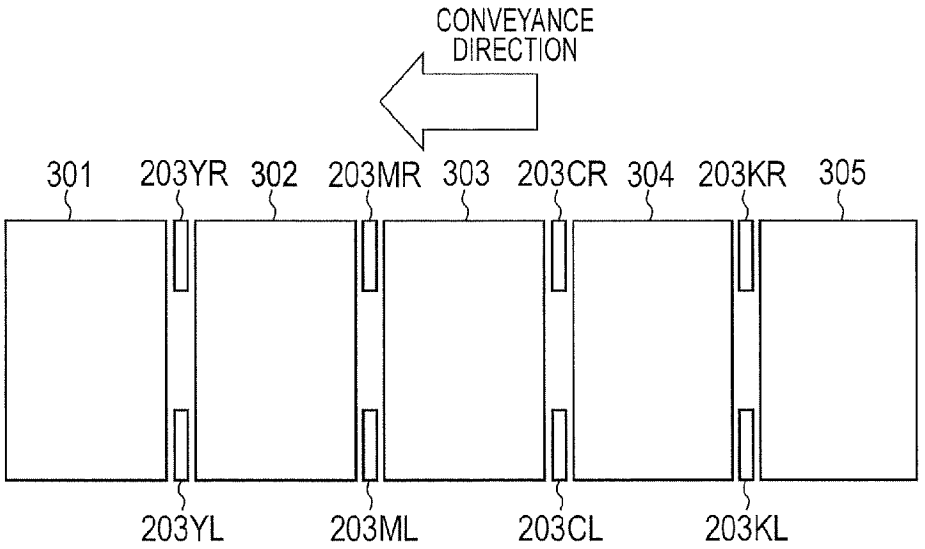
FIG. 2A is an arrangement diagram illustrating a misregistration detection correction pattern between pages in Embodiment 1.

FIG. 2A is a diagram illustrating arrangement of the misregistration detection pattern 203 in a method of detecting and correcting misregistration between pages in this embodiment. In FIG. 2A, the intermediate transfer belt 8 is omitted. The images (301 to 305) of the respective pages and the misregistration detection patterns 203, which have been primarily transferred onto the intermediate transfer belt 8, are conveyed in the illustrated arrow direction. The misregistration detection patterns 203 are arranged as follows. That is, misregistration detection patterns 203YR and 203YL with only one color (e.g. yellow) are arranged between pages, i.e., a first page image 301 and a second page image 302. Misregistration detection patterns 203MR and 203ML with only one color (e.g. magenta) are arranged between pages, i.e., a second page image 302 and a third page image 303. Misregistration detection patterns 203CR and 203CL with only one color (e.g. cyan) are arranged between pages, i.e., a third page image 303 and a fourth page image 304. Misregistration detection patterns 203KR and 203KL with only one color (e.g. black) are arranged between pages, i.e., a fourth page image 304 and a fifth page image 305. Each misregistration detection pattern 203 is thus arranged on a color-by-color basis between the pages, thereby enabling misregistration to be detected between the pages without widening the page intervals. This embodiment exemplifies the image forming apparatus including four color image forming units. As illustrated in FIG. 2A, the misregistration detection patterns with the first to fourth colors are sequentially arranged one by one between the five pages of images. Instead, for instance, in the case of an image forming apparatus including N color image forming units, misregistration detection patterns with a first to N-th colors are sequentially arranged one by one between (N+1) pages of images.

[Method of Correcting Image-Writing Timing of Each Color]

Figure 2B:
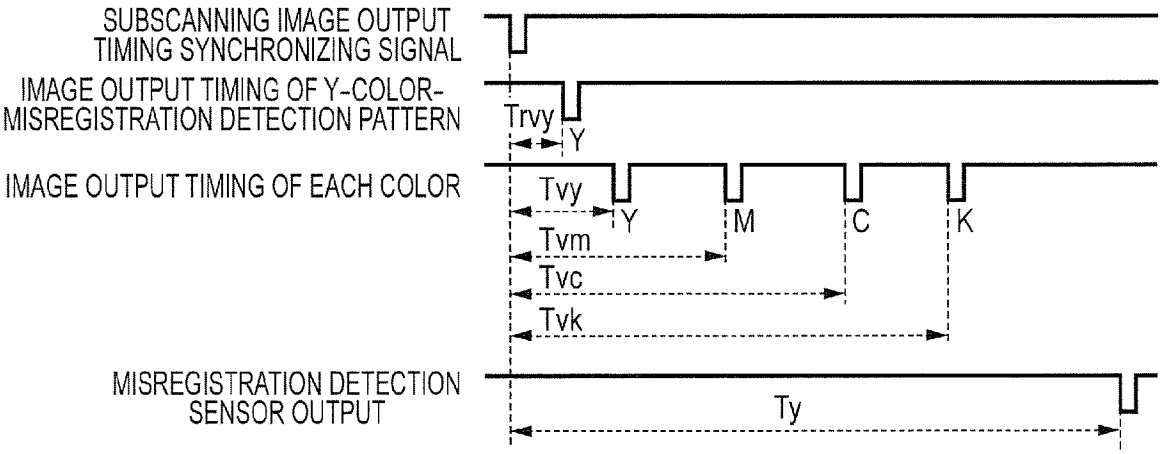
FIG. 2B is a diagram illustrating an operation of image-writing timing.

Referring to FIG. 2B, a method of detecting and correcting misregistration between pages in this embodiment will be described. FIG. 2B illustrates timing and outputs in the case of arranging the Y misregistration detection patterns between the pages in detection and correction of the misregistration between pages. As illustrated in FIG. 2A, after completion of the image-writing of the first page image 301 and before start of the image writing of the second page image 302, the image-writing of Y misregistration detection patterns 203YR and 203YL are started. Thus, FIG. 2B illustrates the timing and outputs of the second page. More specifically, this diagram illustrates a subscanning image-writing timing synchronizing signal, image-writing timing of Y-color-misregistration detection pattern image signal, image-writing timing of each color, and a misregistration detection sensor output. FIG. 2B is on the Y misregistration detection pattern. Instead, in the case of the M misregistration detection patterns 203MR and 203ML, analogous timing and outputs appear on the third page. In the case of the C misregistration detection patterns 203CR and 203CL, analogous timing and outputs appear on the fourth page. In the case of the K misregistration detection patterns 203KR and 203KL, analogous timing and outputs appear on the fifth page. The subscanning image-writing timing synchronizing signal is output from the CPU 40.

In the detection and correction of misregistration between pages in this embodiment, time Trvy after output of the subscanning image-writing timing synchronizing signal, the Y misregistration detection pattern image signal is written. More specifically, the laser unit 7YM irradiates the photosensitive drum 1Y with the laser beam according to the Y misregistration detection pattern image signal. Time Tvy after output of the subscanning image-writing timing synchronizing signal, the Y image signal is output. Likewise, as to the second page image 302, time Tvm, Tvc and Tvk after output of the subscanning image-writing timing synchronizing signal, the respective image signals for the other colors M, C and K are output. The outputs allow an electrostatic latent image to be formed on the photosensitive drum 1. Subsequently, a toner image is formed, and primarily transferred onto the intermediate transfer belt 8. The Y misregistration detection patterns 203YR and 203YL, having been transferred onto the intermediate transfer belt 8, are conveyed to a detection position of the misregistration detection sensor 25 according to conveyance of the intermediate transfer belt 8, and detected by the misregistration detection sensor 25. At this time, the misregistration detection sensor 25 performs masking so as not to detect a pattern other than the misregistration detection pattern 203. That is, when images of the respective pages (e.g. 301 in FIG. 2A) to be secondarily transferred onto the transfer material P are conveyed to the detection position of the misregistration detection sensor 25, the misregistration detection sensor 25 is masked. The masking control in the misregistration detection sensor 25 is performed by the CPU 40.

The detection and correction of the misregistration in this embodiment, the subscanning image-writing timing synchronizing signal is adopted as a reference for measuring time. The CPU 40 causes a timer, not illustrated, to measure time from a falling signal flank of the subscanning image-writing timing synchronizing signal to a falling signal flank of the output signal of the misregistration detection sensor 25 and regards the time as Ty. The time Ty can also regarded as timing at which the CPU 40 detects the falling signal flank of the output signal of the misregistration detection sensor 25. Also as to M, C and K, analogous to Y, times Tm, Tc and Tk from falling signal flanks of the subscanning image-writing timing synchronizing signals to falling signal flanks of the output signals of the misregistration detection sensor 25 between different pages are measured. Times Ty, Tm, Tc and Tk are acquired between pages, and updated every time of detection. More specifically, the terms "between pages" represent that, for instance, times Ty to Tk are acquired on the first to fifth pages, times Ty to Tk are analogously acquired on the sixth to tenth pages, and times Ty to Tk are acquired on the eleventh to fifteenth pages. Note that this scheme is not necessarily applied to a method of updating Ty, Tm, Tc and Tk.

In the case where misregistration occurs between colors, that is, the case where positional deviation occurs between the colors, the positional deviation is represented as deviation between timing Ty, Tm, Tc and Tk acquired by the CPU 40 detecting the output signals of the misregistration detection sensor 25 with reference to the subscanning image-writing timing synchronizing signal. Here, for instance, the color to be the reference (hereinafter, called the reference color) may be Y, and the other colors M, C and K may be colors to be objects (hereinafter, the object colors). In this embodiment, description is made assuming that yellow is the reference color. However, the color is not limited thereto. Provided that the relative amounts of misregistration of the object colors M, C and K with respect to reference color Y are PDm, PDc and PDk, respectively, these amounts are represented by following equations.

$$PDm=Tm-Ty \quad \text{(Equation 1)}$$

$$PDC=Tc-Ty \quad \text{(Equation 2)}$$

$$PDk=Tk-Ty \quad \text{(Equation 3)}$$

The CPU 40 corrects the misregistration detection pattern image signal output timing for object colors M, C and K, and the image signal output timing, based on the amounts of misregistration PDm, PDc and PDk for the object colors M, C and K with respect to the reference color Y, which are represented by (Equation 1) to (Equation 3). In this case, the reference color is Y. Accordingly, correction is not performed on Y.

The misregistration detection pattern image signal output timing Trvm, Trvc and Trvk and the image signal output timing Tvm, Tvc and Tvk after correction can be represented by following equations.

$$Trvm=Trvm(\text{before correction})-PDm \quad \text{(Equation 4)}$$

$$Trvc=Trvc(\text{before correction})-PDc \quad \text{(Equation 5)}$$

$$Trvk=Trvk(\text{before correction})-PDk \quad \text{(Equation 6)}$$

$$Tvm=Tvm(\text{before correction})-PDm \quad \text{(Equation 7)}$$

$$Tvc=Tvc(\text{before correction})-PDc \quad \text{(Equation 8)}$$

$$Tvk=Tvk(\text{before correction})-PDk \quad \text{(Equation 9)}$$

The CPU 40 corrects the misregistration detection pattern image signal output timing Trvm, Trvc and Trvk using (Equation 4) to (Equation 6). The CPU 40 corrects the image signal output timing Tvm, Tvc and Tvk using (Equation 7) to (Equation 9). The timing corrected by the (Equation 4) to (Equation 9) is reflected to image-writing to be performed after the correction.

[Process of Detecting and Correcting Misregistration]

Figures 3, 3A:
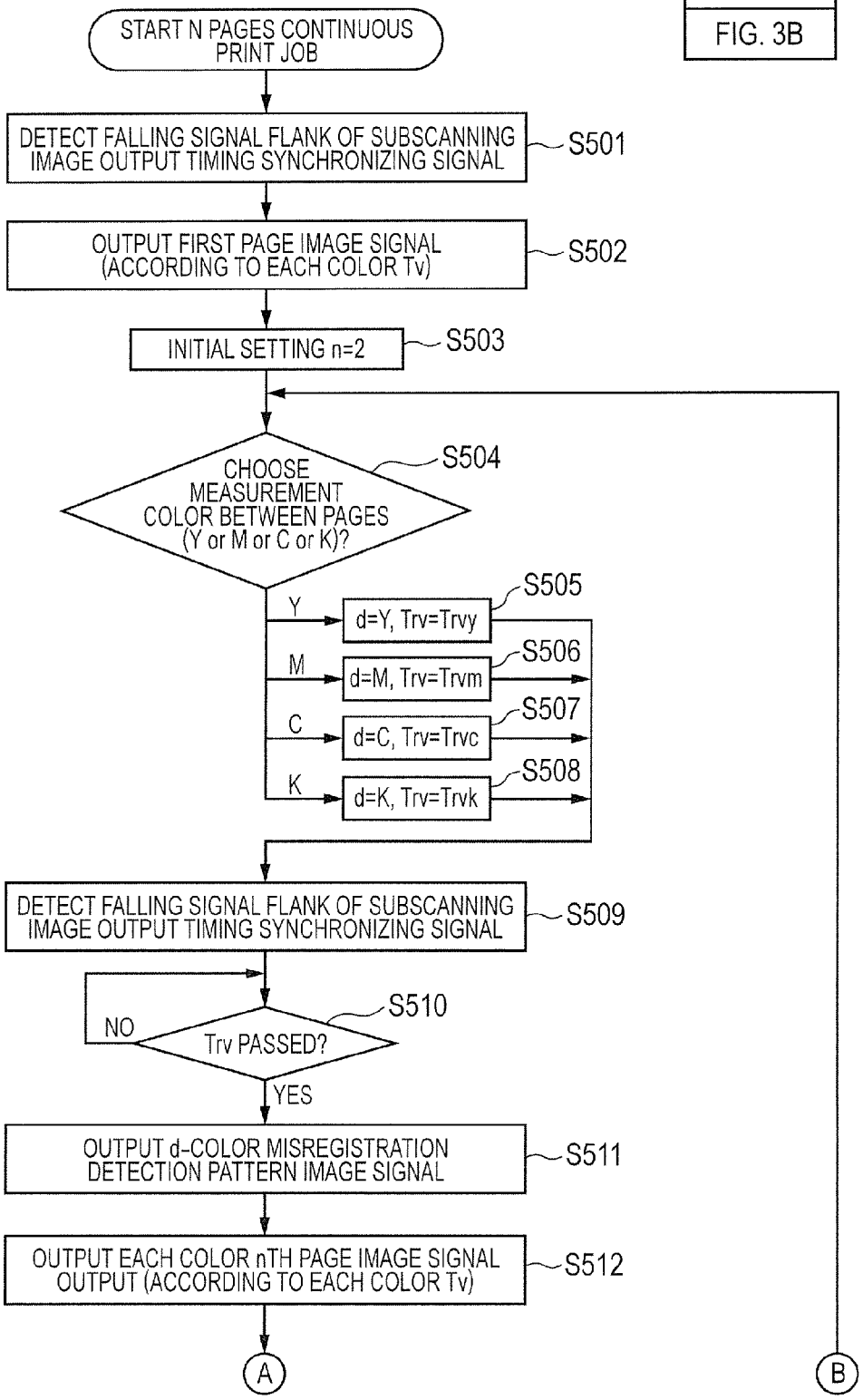
FIG. 3 which consists of FIGS. 3A and 3B are flowcharts of a process of detecting and correcting misregistration in Embodiment 1.
Figure 3B:
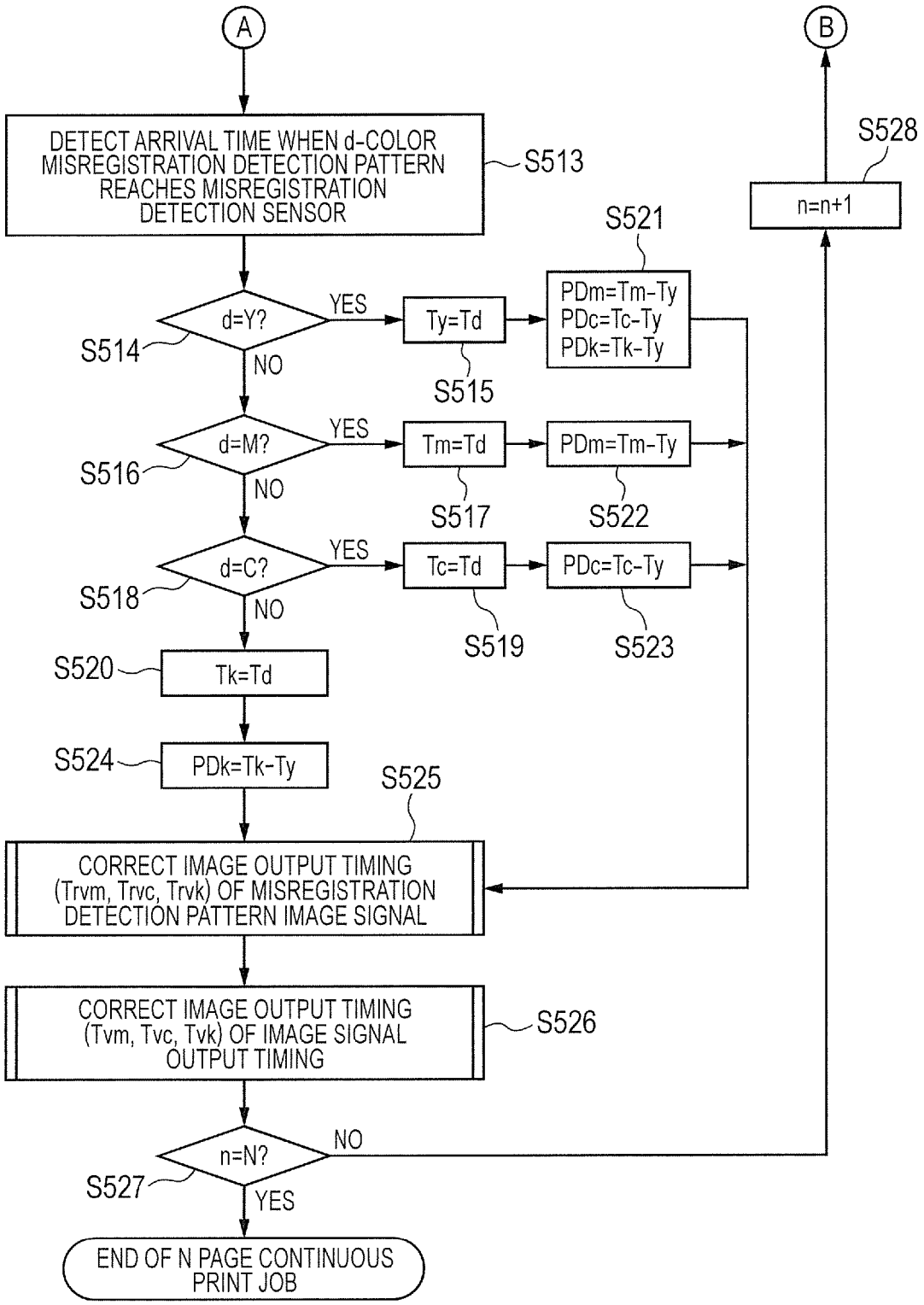

Referring to flowcharts of FIGS. 3A and 3B, the flow of the method of detecting and correcting misregistration between pages in this embodiment will be described. In FIGS. 3A and 3B, the description is made exemplifying a print job that sequentially forms N pages of images. Formation of the N color misregistration detection patterns as described above one by one between pages in the print job requires that the print job is for forming at least (N+1) pages of images. For instance, formation of two color misregistration detection patterns requires that the print job is for forming at least three pages of images. For instance, formation of four color misregistration detection pattern as with this embodiment requires that the print job is for forming at least five pages of images; N is at least 5 (N≥5).

After start of an N-page continuous print job, in step (hereinafter, called "S") 501, the CPU 40 detects a falling signal flank of the subscanning image-writing timing synchronizing signal, and starts the timer, not illustrated. This embodiment adopts, as the reference, the timing at which the falling signal flank of the subscanning image-writing timing synchronizing signal is detected. However, for instance, the reference may be the image-writing timing of the misregistration detection pattern image signal. Timing to be the reference is not limited to the timing in this embodiment. In S502, the CPU 40 refers to the timer, and outputs the image signal for the first page (e.g. corresponding to 301 in FIG. 2A) according to each color and the image signal output timing Tvy, Tvm, Tvc and Tvk, and resets the timer, not illustrated. In S503, the CPU 40 performs initial setting where the counter n (not illustrated) is set to 2 (n=2). Next, in S504, the CPU 40 chooses on which color the measurement is performed between pages. In S505 to S508, the measurement color d between pages and the misregistration detection pattern image signal output timing Trv are set. In this embodiment, the misregistration detection pattern 203 with only one color is formed between pages. Accordingly, in S504, the CPU 40 chooses only one color.

Only one of the processes in S505 to S508 is performed. For instance, in S504, in the case where the CPU 40 chooses yellow as the color on which measurement is performed, the processing proceeds to S505. The measurement color d between pages is set to Y (d=Y), and the misregistration detection pattern image signal output timing Trv is set to Trvy (Trv=Trvy). Likewise, in S504, in the case where the CPU 40 chooses magenta as the color on which measurement is performed, the processing proceeds to S506. The measurement color d between pages is set to M (d=M). The misregistration detection pattern image signal output timing Trv is set to Trvm (Trv=Trvm). Even in the case of choosing any of cyan and black, the CPU 40 performs analogous processes in S507 and S508.

In S509, the CPU 40 detects the falling signal flank of the subscanning image-writing timing synchronizing signal, and starts the timer, not illustrated. Processes in and after S509 are performed for forming images on and after the second page. In S510, the CPU 40 determines whether the time Trv set in S505 to S508 by the timer has elapsed or not. After elapse of the time Trv, in S511, the misregistration detection pattern image signal of the measurement color d between pages is output. For instance, in the case where the color chosen in S504 by the CPU 40 is yellow, after the time Trvy has elapsed in S510, the Y-color-misregistration detection pattern image signal is output in S511. In S512, the CPU 40 outputs the image signal for the n-th page according to each color image signal output timing Tvy, Tvm, Tvc and Tvk. For instance, in the case of n=2, the CPU 40 outputs the image signal for the second page.

In S513, the arrival time Td when the misregistration detection pattern 203 with the measurement color d between pages reaches the misregistration detection sensor 25 is detected. That is, the CPU 40 detects the falling signal flank of the output signal of the misregistration detection sensor 25, refers to the value of the timer, which is not illustrated and has been started in S509, and measures the arrival time Td. In S514 to S520, the CPU 40 stores the arrival times Td detected according to the measured colors in Ty, Tm, Tc and Tk, respectively. More specifically, in S514, the CPU 40 determines whether the measurement color d between pages is Y or not. If determining that the measurement color d between pages is Y, this CPU sets the arrival time Td measured at the arrival time Ty for yellow in S515. If the CPU 40 determines that the measurement color d between pages is not Y in S514, this CPU determines whether the measurement color d between pages is M or not in S516. After determining that the measurement color d between pages is M in S516, the CPU 40 sets the arrival time Td measured on the arrival time Tm for magenta in S517. If determining that the measurement color d between pages is not M in S516, the CPU 40 determines whether the measurement color d between pages is C or not in S518. If determining that the measurement color d between pages is C in S518, the CPU 40 sets the arrival time Td measured on the arrival time Tc for cyan in S519. If determining that the measurement color d between pages is not C in S518, the CPU 40 sets the arrival time Td measured on the arrival time Tk for black in S520.

In S521 to S524, the CPU 40 calculates the amounts of misregistration PDm, PDc and PDk for the respective object colors M, C and K with respect to the reference color Y using (Equation 1) to (Equation 3). In this embodiment, yellow patches are formed between the first and second pages and regarded as the reference color. However, any color may be the reference color, and any reference color may be formed between any pages. More specifically, since having thus measured the arrival time Td for the reference color Y in S521, the CPU 40 calculates the amounts of misregistration PDm, PDc and PDk for the respective object colors M, C and K according to (Equation 1) to (Equation 3). For instance, if there are values set as initial values or values measured before this process, these values are adopted as Tm, Tc and Tk for the respective object colors M, C and K. Ty in S522 to S524 is analogous thereto. Since measuring the arrival time Td for the object color M, the CPU 40 calculates the amount of misregistration PDm for the object color M according to (Equation 1) in S522. Since measuring the arrival time Td for the object color C, the CPU 40 calculates the amount of misregistration PDc for the object color C according to (Equation 2) in S523. Since measuring the arrival time Td for the object color K, the CPU 40 calculates the amount of misregistration PDk for the object color K according to (Equation 3) in S524.

In S525, the CPU 40 performs correction using the amounts of misregistration PDm, PDc and PDk, which are calculated in S521 to S524 and updated each time of detecting misregistration between pages. That is, the CPU corrects the misregistration detection pattern image signal output timing Trvm, Trvc and Trvk according to (Equation 4) to (Equation 6). In S526, the CPU 40 corrects the image signal output timing Tvm, Tvc and Tvk according to (Equation 7) to (Equation 9) using the amounts of misregistration PDm, PDc and PDk, which are calculated in S521 to S524 and updated each time of detecting color misregistration between pages. The CPU 40 resets the timer, not illustrated.

In S527, the CPU 40 determines whether or not n is N, i.e., the final page N in the continuous print job. If n is not the final page N, the counter n is incremented (n=n+1) in S528, the processing returns to the process in S504. If the CPU 40 determines that n=N in S527, the N-page continuous print job is finished, and the detection and correction of the misregistration between pages are finished.

In this embodiment, the misregistration detection pattern with only one color is thus formed between pages. Accordingly, misregistration can be corrected at short page intervals, thereby allowing misregistration due to rise in temperature to be decreased without reducing throughput. As described above, according to this embodiment, the pattern image for correcting misregistration between pages can be formed without widening page intervals, the misregistration correction process can be performed, and misregistration due to variation in laser irradiation position accompanying variation in temperature can be reduced.

This embodiment has described the example that forms the misregistration detection pattern with only one color between pages. However, the configuration is not limited thereto. For instance, if detection patterns with at least two colors can be formed without widening the page intervals, the detection patterns with at least two colors may be formed. Also in this case, the amount of misregistration can be calculated based on the misregistration detection pattern image signal output timing without forming the reference patch. Accordingly, the region where the pattern image is formed can be suppressed, which can, in turn, suppress unnecessary widening of sheet interval.

This embodiment has described the example of forming the misregistration detection pattern between pages. However, the configuration is not limited thereto. For instance, the misregistration detection pattern can be formed after the finally formed page. Also in this case, the amount of misregistration can be calculated based on the misregistration detection pattern image signal output timing without forming the reference patch. The region where the pattern image is formed can be suppressed, which can, in turn, suppress time required to detect the misregistration.

Embodiment 2

[Problem of Intermittent Printing]

The method of detecting and correcting misregistration between pages in Embodiment 1 adopts one color as the reference color, regards the colors other than the one color as object colors, calculates the relative amount of misregistration with reference to the reference color, and is applicable in the case of a continuous print job for at least three pages. Accordingly, in a continuous printing for two pages, Ty for only one color is measured, and the relative amount of misregistration between the reference color and the object color cannot be calculated. Thus, in the case of a continuous print job for only two pages, the misregistration detection pattern with the reference color may be formed and measured, and the misregistration detection pattern with the object color may be formed on and after the second page in the multi-page continuous print job and measured. However, there is a possibility that a thermal shift occurs between the continuous print job for only two pages and the next multi-page continuous print job.

Figure 4:
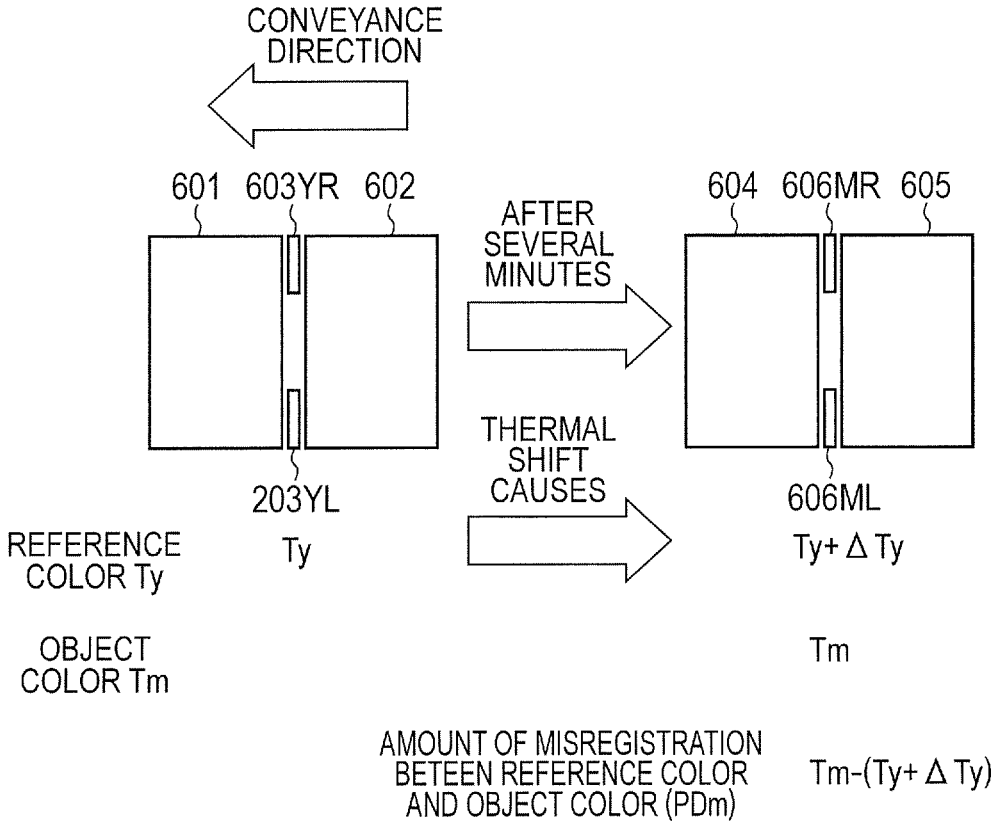
FIG. 4 is a diagram illustrating an effect by a thermal shift in Embodiment 2.

Here, referring to FIG. 4, the case of using control of detection and correction of misregistration between pages in Embodiment 1 for, e.g., continuous intermittent printing for several minutes for two pages will be described. The misregistration detection patterns 603YR and 603YL with the reference color (e.g. yellow) are arranged between pages including 601 and 602 in a first two-page continuous print job. The CPU 40 measures the time Ty from the falling signal flank of the subscanning image-writing timing synchronizing signal for the second page to the falling signal flank of the output signal whose misregistration detection patterns 603YR and 603YL are detected by the misregistration detection sensor 25. Next, after several minutes, the misregistration detection patterns 606MR and 606ML with the object color (e.g. magenta) are arranged between pages including 604 and 605 in a second tow-page continuous print job. The CPU 40 measures the time Tm from the falling signal flank of the subscanning image-writing timing synchronizing signal for the second page to the falling signal flank of the output signal whose misregistration detection patterns 606MR and 606ML are detected by the misregistration detection sensor 25. If a thermal shift ΔTy occurs on, for instance, Y, which is the reference color, in several minutes between 602 and 604, there is a possibility that the amount of misregistration PDm with the object color with respect to the reference color cannot correctly be calculated. In this case, there is a possibility that accurate correction cannot be performed. In Embodiment 1, the CPU 40 acquires the amount of misregistration between the reference color and the object color according to (Equation 1) (PDm=Tm−Ty). However, the occurring thermal shift ΔTy is not considered in Ty here. As illustrated in FIG. 4, as to the reference color, (Ty+ΔTy) is a value in which a thermal shift is considered. The amount of misregistration between the reference color and the object color in which the thermal shift is considered should be PDm=Tm−(Ty+ΔTy).

This embodiment will describe a method of detecting and correcting misregistration between pages according to such a situation. The configuration of this embodiment is the same as the configuration of Embodiment 1. The configurations are different only in method of calculating and correcting misregistration between pages. The same configurational elements in Embodiment 1 are assigned with the same symbols. The description thereof is omitted.

[Correction of Correction Reference Time and the Amount of Misregistration]

In this embodiment, when the misregistration between pages is detected, Ty is measured and the correction reference determination sequence is performed where Ty at this time is adopted as the color misregistration correction reference time Tx (hereinafter, simply called the correction reference time Tx). In this embodiment, the yellow Ty is measured and adopted as the correction reference time Tx. However, Tm, Tc and Tk of other colors M, C and K may be measured and adopted as the correction reference time Tx. In this embodiment, the correction reference time Tx is determined according to the correction reference determination sequence, and subsequently, times Ty, Tm, Tc and Tk from the falling signal flank of the subscanning image-writing timing synchronizing signal to the falling signal flank of the output signal detected by the misregistration detection sensor 25 are measured between pages. Then, control is performed such that the times Ty, Tm, Tc and Tk are always the same as the correction reference time Tx. The times Ty, Tm, Tc and Tk are acquired between pages and updated at every detection. However, the method of updating Ty, Tm, Tc and Tk is not necessarily analogous thereto.

Provided that the amounts of misregistration of Y, M, C and K with respect to the correction reference time Tx are PDy, PDm, PDc and PDk, respectively, these amounts are represented as follows.

$$PDy=Ty-Tx \quad \text{(Equation 10)}$$

$$PDm=Tm-Tx \quad \text{(Equation 11)}$$

$$PDc=Tc-Tx \quad \text{(Equation 12)}$$

$$PDk=Tk-Tx \quad \text{(Equation 13)}$$

The CPU 40 corrects the misregistration detection pattern image signal output timing of Y, M, C and K and the image signal output timing, from the amounts of misregistration PDy, PDm, PDc and PDk ((Equation 10) to (Equation 13)) on Y, M, C and K with respect to the correction reference time Tx.

The corrected misregistration detection pattern image signal output timing Trvy, Trvm, Trvc and Trvk, and the image signal output timing Tvy, Tvm, Tvc and Tvk can be represented as follows.

$$Trvy=Trvy(\text{before correction})-PDy \quad \text{(Equation 14)}$$

$$Trvm=Trvm(\text{before correction})-PDm \quad \text{(Equation 15)}$$

$$Trvc=Trvc(\text{before correction})-PDc \quad \text{(Equation 16)}$$

$$Trvk=Trvk(\text{before correction})-PDk \quad \text{(Equation 17)}$$

$$Tvy=Tvy(\text{before correction})-PDy \quad \text{(Equation 18)}$$

$$Tvm=Tvm(\text{before correction})-PDm \quad \text{(Equation 19)}$$

$$Tvc=Tvc(\text{before correction})-PDc \quad \text{(Equation 20)}$$

$$Tvk=Tvk(\text{before correction})-PDk \quad \text{(Equation 21)}$$

The CPU 40 corrects the misregistration detection pattern image signal output timing Trvy, Trvm, Trvc and Trvk using (Equation 14) to (Equation 17). The CPU 40 corrects the image signal output timing Tvy, Tvm, Tvc and Tvk using (Equation 18) to (Equation 21).

[Correction Reference Determination Sequence]

Figure 5:
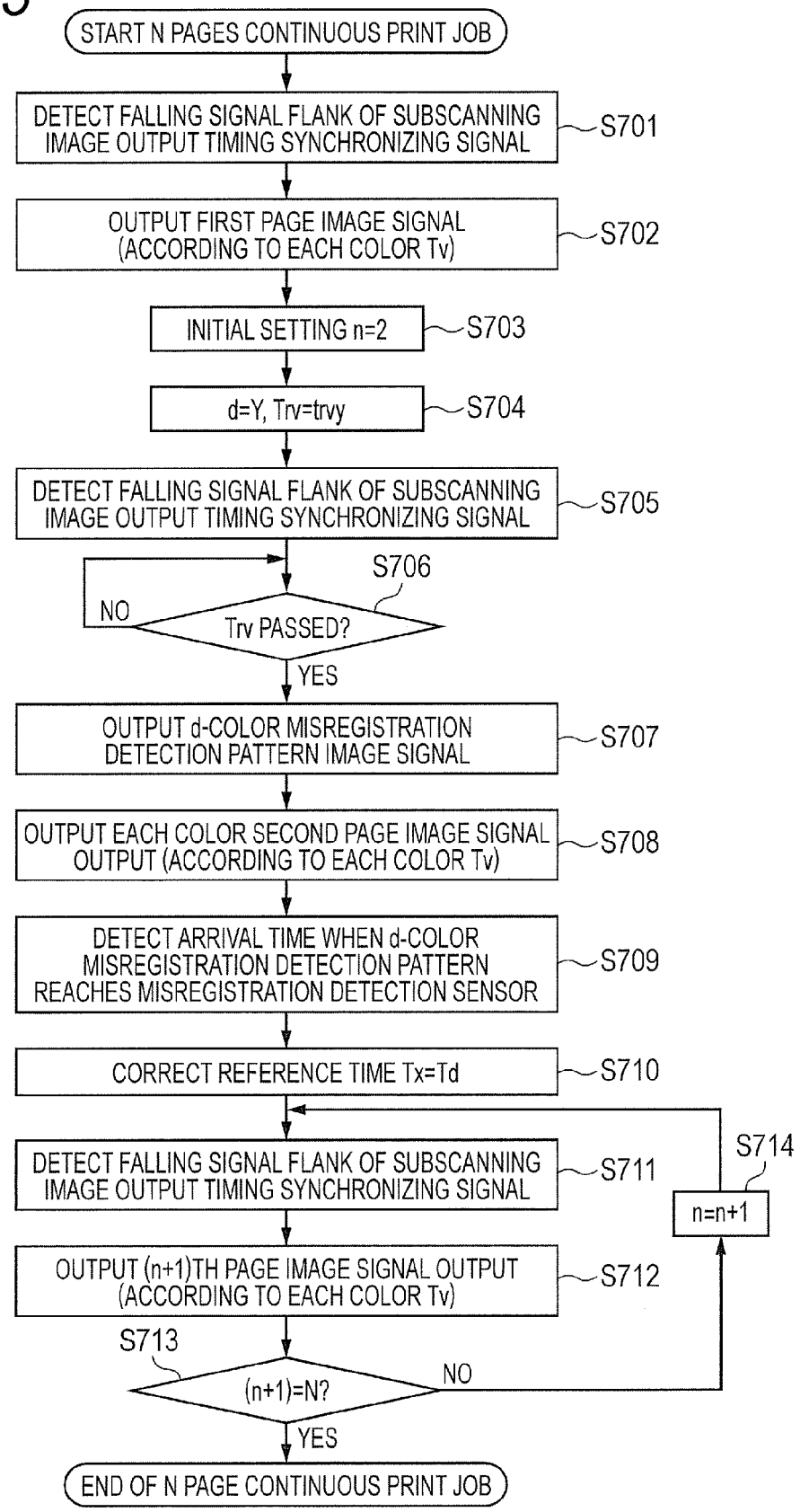
FIG. 5 is a flowchart of a process of determining correction reference time in Embodiment 2.

Referring to FIG. 5, the flow of the correction reference determination sequence between pages in this embodiment will be described. The output timing of each signal is the same as the timing in FIG. 2B described in Embodiment 1. After start of the N-page continuous print job, in S701, the CPU 40 detects the falling signal flank of the subscanning image-writing timing synchronizing signal, and starts the timer, not illustrated. In S702, the CPU 40 refers to the timer, outputs an image signal on the first page according to the image signal output timing Tvy, Tvm, Tvc and Tvk of each color (e.g. corresponding to 601 in FIG. 4), and resets the timer, not illustrated. In S703, the CPU 40 sets the counter n, not illustrated, to 2, and performs the initial setting. In S704, the CPU 40 sets the measurement color d between pages and the misregistration detection pattern image signal output timing Trv. For instance, the CPU 40 sets the measurement color d between pages to yellow (d=Y), and sets the misregistration detection pattern image signal output timing Trv to Trvy (Trv=Trvy).

In S705, the CPU 40 detects the falling signal flank of the subscanning image-writing timing synchronizing signal on the n-th page (the second page in this case), and starts the timer, not illustrated. In S706, the CPU 40 determines whether the time Trv (=Trvy) has elapsed or not using the timer, not illustrated. In S706, the CPU 40 returns the processing to the process in S706 unless the time Trv has elapsed. In S706, after the CPU 40 determines that the time Trv has elapsed, this CPU outputs the d (color) misregistration detection pattern image signal in S707. In this case, the CPU 40 outputs the Y-color-misregistration detection pattern image signal (e.g. corresponding to 603YR and 603YL in FIG. 4). In S708, the CPU 40 outputs the image signal on the n-th page (the second page in this case) (e.g. corresponding to 602 in FIG. 4) according to the image signal output timing Tvy, Tvm, Tvc and Tvk of each color. In S709, the CPU 40 detects the arrival time (Td) of the d misregistration detection pattern (in this case, Y misregistration detection pattern) to the misregistration detection sensor 25, and, in S710, this CPU sets the correction reference time Tx to Td. The CPU 40 resets the timer.

In S711, the CPU 40 detects the falling signal flank of the subscanning image-writing timing synchronizing signal on the (n+1) page (the third page in this case), and starts the timer, not illustrated. In S712, the CPU 40 outputs the image signal on the (n+1)-th page (the third page in this case) at timing according to each color Tv, and subsequently resets the timer. In S713, the CPU 40 determines whether (n+1) is N or not. If the CPU determined that (n+1) is not N, the CPU increments n (n=n+1) in S714 and the processing returns to S711. In S713, the CPU 40 determines that (n+1) is N ((n+1)=N), the CPU finishes the N-page continuous print job and finishes the correction reference determination sequence. Thus, in the processes in S711 to S714 after S710 determining the correction reference time Tx, the misregistration detection pattern is not output between pages. That is, in the correction reference determination sequence, the misregistration detection pattern of one color is formed only between pages that are the (n−1)-th page (e.g. the first page) and the n-th page (e.g. the second page) and detected, but the misregistration detection pattern is not formed between pages after the n-th page.

[Process of Detecting and Correcting Misregistration]

Referred to FIGS. 6A and 6B, the flow of the method of detecting and correcting misregistration between pages in this embodiment will be described. The processes in S801 to S820, S827 and S828 are identical to the processes in S501 to S520, S527 and S528 described with reference to FIGS. 3A and 3B in Embodiment 1. The description thereof is omitted. In this embodiment, there is no distinction between the reference color and the object color. Accordingly, the terms of the "reference color" and the "object color" described with reference to FIGS. 3A and 3B are simply regarded as "colors". In S821 to S824, the CPU 40 calculates the amounts of misregistration PDy, PDm, PDc and PDk of Y, M, C and K with respect to the correction reference time Tx set in the correction reference determination sequence. More specifically, in S821, since the CPU 40 measures Td of Y, the CPU calculates the amount of misregistration PDy of Y with respect to the correction reference time Tx using (Equation 10). In S822, since the CPU 40 measures Td of M, the CPU calculates the amount of misregistration PDm of M with respect to the correction reference time Tx using (Equation 11). In S823, since the CPU 40 measures Td of C, the CPU calculates the amount of misregistration PDc of C with respect to the correction reference time Tx using (Equation 12). In S824, since the CPU 40 measures Td of K, the CPU calculates the amount of misregistration PDk of K with respect to the correction reference time Tx using (Equation 13).

In S825, the CPU 40 performs following processes using PDy, PDm, PDc and PDk updated in detection of the misregistration between pages calculated in S821 to S824. That is, the CPU 40 corrects the misregistration detection pattern image signal output timing Trvy, Trvm, Trvc and Trvk according to (Equation 14) to (Equation 17). In S826, the CPU 40 corrects the image signal output timing Tvy, Tvm, Tvc and Tvk using PDy, PDm, PDc and PDk updated in detection of the misregistration between pages calculated in S821 to S824 according to (Equation 18) to (Equation 21).

As described above, according to this embodiment, in calibration at short page intervals, the amount of misregistration of each color can be measured and corrected at each sheet interval, thereby allowing misregistration due to rise in temperature to be reduced. If a thermal shift occurs in a print job including only two pages and in occurrence of intermittent for several minutes in continuous printing of N pages for several minutes, the amount of misregistration of each color can be accurately measured and corrected.

As described above, according to this embodiment, the pattern image for correcting misregistration is formed between pages without widening the page interval, the misregistration correction process is executed, which can reduce misregistration due to variation in laser irradiation position accompanying variation in temperature.

Embodiment 3

The method of detecting and correcting misregistration between pages in Embodiment 2 performs the correction reference determination sequence. Thus, the detection and correction of the misregistration cannot be performed in the correction reference determination sequence. Accordingly, there is a possibility that misregistration occurs in an image-writing in the correction reference determination sequence. To address thereto, it can be considered that any correction reference time Tx can be preliminarily determined without executing the correction reference determination sequence. In the case of thus determining any correction reference time Tx, detection and correction of the misregistration can be performed from the first page. However, with certain variation in color, there is a possibility that the misregistration cannot be reduced instead. This embodiment will describe a configuration that determines the correction reference time Tx and detects and corrects the misregistration in the misregistration detection and correction sequence. That is, the configuration will be described that performs the process of detecting and correcting misregistration while determining the correction reference time Tx. The configuration of this embodiment is the same as the configuration of Embodiment 1. The configurations are different only in method of calculating and correcting misregistration between pages. The same configurational elements in Embodiment 1 are assigned with the same symbols. The description thereof is omitted.

[Misregistration Detection Pattern]

This embodiment includes the main color misregistration detection and correction sequence according to which the misregistration detection sensor 25 detects the misregistration detection pattern (FIG. 7A) allowing measurement of the relative amount of misregistration of the object color with respect to the reference color, and calculates the amounts of misregistration PDm, PDc and PDk of the object colors with reference to the reference color. At the same time, the time Ty from the falling signal flank of the subscanning image-writing timing synchronizing signal to output of the reference color of the misregistration detection sensor 25 is measured. The time Ty at this time is regarded as the misregistration correction reference time Tx. The main color misregistration detection and correction sequence of this embodiment is executed in the case where the print job is not executed, and the case where the misregistration is assumed to be large, for instance, the case where the power source is on, the case after returning from sleep, and the case after changing of a cartridge.

Figure 7A:
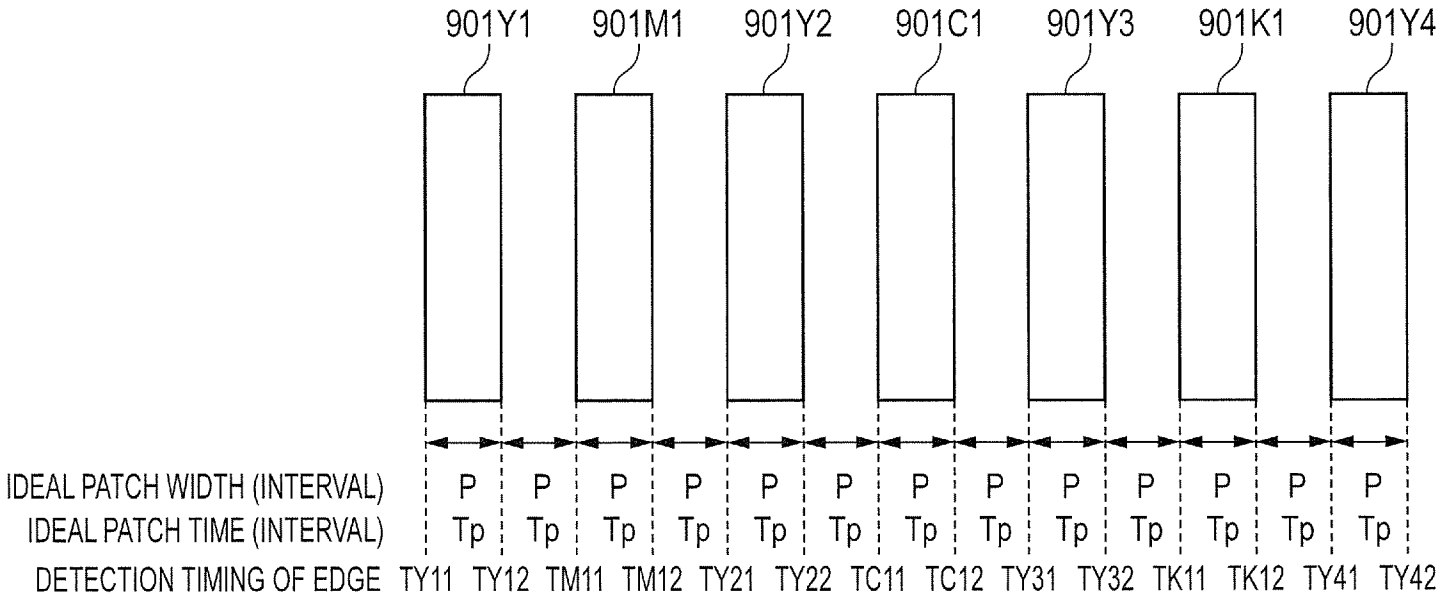
FIG. 7A is an arrangement diagram of a main color misregistration detection correction pattern in Embodiment 3.

FIG. 7A illustrates that the misregistration detection pattern allowing measurement of the amount of misregistration of the object color with reference to the reference color, where the ideal patch width of each patch and the ideal patch interval are P (Tp after time conversion). FIG. 7A illustrates timing when each edge is detected (TY11 etc.). This timing is at a time after the falling signal flank of the subscanning image-writing timing synchronizing signal. The misregistration detection pattern illustrated in FIG. 7A is sequentially formed such that a yellow patch 901Y1, a magenta patch 901M1, a yellow patch 902Y2, a cyan patch 901C1, . . . . That is, four patches (901Y1 to 901Y4) with the reference color (e.g. yellow) are formed, and the patches (901M1, 901C1, 901K1) with the object colors (e.g., colors other than yellow) are formed between the yellow patches. Thus, in the misregistration detection pattern of this embodiment, the reference color and the object color are alternately formed. The amounts of misregistration PDm, PDc and PDk in the misregistration detection and correction sequence of the object colors with reference to the reference color used for the misregistration detection and correction sequence in this embodiment can be represented according to following equations. In this embodiment, for instance, yellow is the reference color, and the colors other than yellow are the object colors.

$$PDm=(TM11+TM12)/2-\{(TY11+TY12)/2+(TY21+TY22)/2\}/2 \quad \text{(Equation 22)}$$

$$PDc=(TC11+TC12)/2-\{(TY21+TY22)/2+(TY31+TY32)/2\}/2 \quad \text{(Equation 23)}$$

$$PDk=(TK11+TK12)/2-\{(TY31+TY32)/2+(TY41+TY42)/2\}/2 \quad \text{(Equation 24)}$$

The time Ty at this time can be represented according to the following equation using the ideal patch time Tp (see FIG. 7A), and it is provided that the correction reference time Tx=Ty.

$$Ty=TY11+[\{TY12-(TY11+Tp)\}+\{TY21-(TY11+4Tp)\}+\{TY22-(TY11+5Tp)\}+\{TY31-(TY11+8Tp)\}+\{TY32-(TY11+9Tp)\}+\{TY41-(TY11+12Tp)\}+\{TY42-(TY11+13Tp)\}]/7 \quad \text{(Equation 25)}$$

In an ideal case, TY12=TY11+Tp. Accordingly, the numerator of the second term on the right side of (Equation 25) is ideally zero, and Ty=TY11. In other words, in the case where the numerator of the second term on the right side of (Equation 25) is not zero, it can be considered that misregistration has occurred owing to, for instance, a thermal shift.

The corrected misregistration detection pattern image signal output timing Trvm, Trvc and Trvk and image signal output timing Tvm, Tvc and Tvk can be represented according to following equations.

$$Trvm=Trvm(\text{before correction})-PDm \quad \text{(Equation 26)}$$

$$Trvc=Trvc(\text{before correction})-PDc \quad \text{(Equation 27)}$$

$$Trvk=Trvk(\text{before correction})-PDk \quad \text{(Equation 28)}$$

$$Tvm=Tvm(\text{before correction})-PDm \quad \text{(Equation 29)}$$

$$Tvc=Tvc(\text{before correction})-PDc \quad \text{(Equation 30)}$$

$$Tvk=Tvk(\text{before correction})-PDk \quad \text{(Equation 31)}$$

The CPU 40 of this embodiment calculates the time Ty for the reference color, and sets the correction reference time Tx to the time Ty. In this embodiment, misregistration for every color is eliminated by correction using (Equation 26) to (Equation 31). Accordingly, Td (Ty, Tm, Tc and Tk) for every color is identical to Tx. Thus, in this embodiment, the correction reference time Tx is determined ((Equation 25)), and the process of detecting and correcting misregistration is performed ((Equation 22) to (Equation 24) and (Equation 26) to (Equation 31)).

Subsequently, as described in Embodiment 2, the times Ty, Tm, Tc and Tk from the falling signal flank of the subscanning image-writing timing synchronizing signal to the output of the misregistration detection sensor 25 between pages are measured. The detection and correction of the misregistration are performed such that the times Ty, Tm, Tc and Tk are always identical to the correction reference time Tx. The times Ty, Tm, Tc and Tk are updated every time of acquisition and detection between pages. The method of updating the times Ty, Tm, Tc and Tk is not necessarily analogous thereto.

Provided that the amount of misregistration of Y, M, C and K with respect to the correction reference time Tx are PDy, PDm, PDc and PDk, respectively, these amounts are represented as follows.

$$PDy=Ty-Tx \quad \text{(Equation 32)}$$

$$PDm=Tm-Tx \quad \text{(Equation 33)}$$

$$PDc=Tc-Tx \quad \text{(Equation 34)}$$

$$PDk=Tk-Tx \quad \text{(Equation 35)}$$

The CPU 40 corrects the misregistration detection pattern image signal output timing of Y, M, C and K and the image signal output timing according to the amounts of misregistration PDy, PDm, PDc and PDk of Y, M, C and K with respect to the correction reference time Tx.

The corrected misregistration detection pattern image signal output timing Trvy, Trvm, Trvc and Trvk and image signal output timing Tvy, Tvm, Tvc and Tvk can be represented according to following equations.

$$Trvy=Trvy(\text{before correction})-PDy \quad \text{(Equation 36)}$$

$$Trvm=Trvm(\text{before correction})-PDm \quad \text{(Equation 37)}$$

$$Trvc=Trvc(\text{before correction})-PDc \quad \text{(Equation 38)}$$

$$Trvk=Trvk(\text{before correction})-PDk \quad \text{(Equation 39)}$$

$$Tvy=Tvy(\text{before correction})-PDy \quad \text{(Equation 40)}$$

$$Tvm=Tvm(\text{before correction})-PDm \quad \text{(Equation 41)}$$

$$Tvc=Tvc(\text{before correction})-PDc \quad \text{(Equation 42)}$$

$$Tvk=Tvk(\text{before correction})-PDk \quad \text{(Equation 43)}$$

The CPU 40 corrects the misregistration detection pattern image signal output timing Trvy, Trvm, Trvc and Trvk using (Equation 36) to (Equation 39). The CPU 40 corrects the image signal output timing Tvy, Tvm, Tvc and Tvk using (Equation 40) to (Equation 43).

Figure 7B:
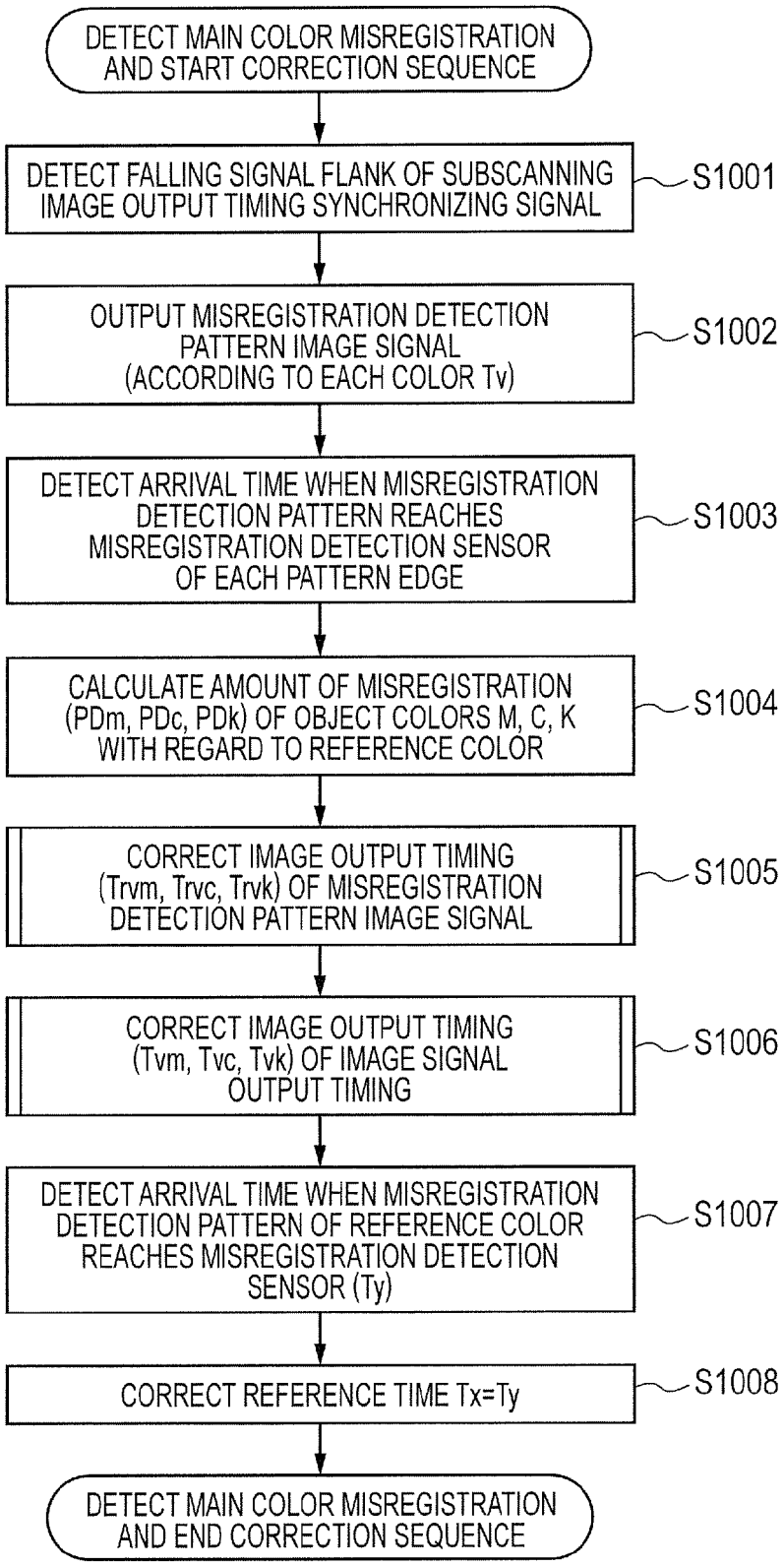
FIG. 7B is a flowchart of a process of detecting and correcting misregistration.

Subsequently, referring to FIG. 7B, the flow of the main color misregistration detection and correction sequence in this embodiment will be described. After start of the main color misregistration detection and correction sequence, in S1001 the CPU 40 detects the falling signal flank of the subscanning image-writing timing synchronizing signal and starts the timer, not illustrated. In S1002, the CPU 40 outputs the misregistration detection pattern image signal (e.g., 901Y1 to 901Y4, 901M1, 901C1 and 901K1 in FIG. 7A) according to the image signal output timing Trvy, Trvm, Trvc and Trvk of the respective colors. In S1003, the CPU 40 detects the arrival time when each pattern edge of the misregistration detection pattern reaches the misregistration detection sensor 25 using the timer, not illustrated. For instance, as illustrated in FIG. 7A, the CPU 40 detects the edges of the patches 901Y1 to 901Y4, 901M1, 901C1 and 901K1 of the misregistration detection patterns, and measures the time TY11 using the timer, not illustrated.

In S1004, the CPU 40 calculates the amounts of misregistration PDm, PDc and PDk of the respective object colors M, C and K with respect to the reference color Y from the arrival time (TY11 etc.) to the misregistration detection sensor 25 detected in S1003 using (Equation 22) to (Equation 24) ((Equation 22) to (Equation 24)). In S1005, the CPU 40 corrects the misregistration detection pattern image signal output timing Trvm, Trvc and Trvk using the PDm, PDc and PDk calculated in S1004 according to (Equation 26) to (Equation 28). In S1006, the CPU 40 corrects the image signal output timing Tvm, Tvc and Tvk using PDm, PDc and PDk calculated in S1004 according to (Equation 29) to (Equation 31). In S1007, the CPU 40 calculates Ty from the arrival time (TY11 etc.) when the pattern edge of the reference color Y of the misregistration detection pattern detected in S1003 reaches the misregistration detection sensor, and the ideal patch time Tp, according to (Equation 25). In S1008, the CPU 40 sets the correction reference time Tx to Ty calculated in S1007, and finishes the main color misregistration detection and correction sequence.

Figures 6, 6A:
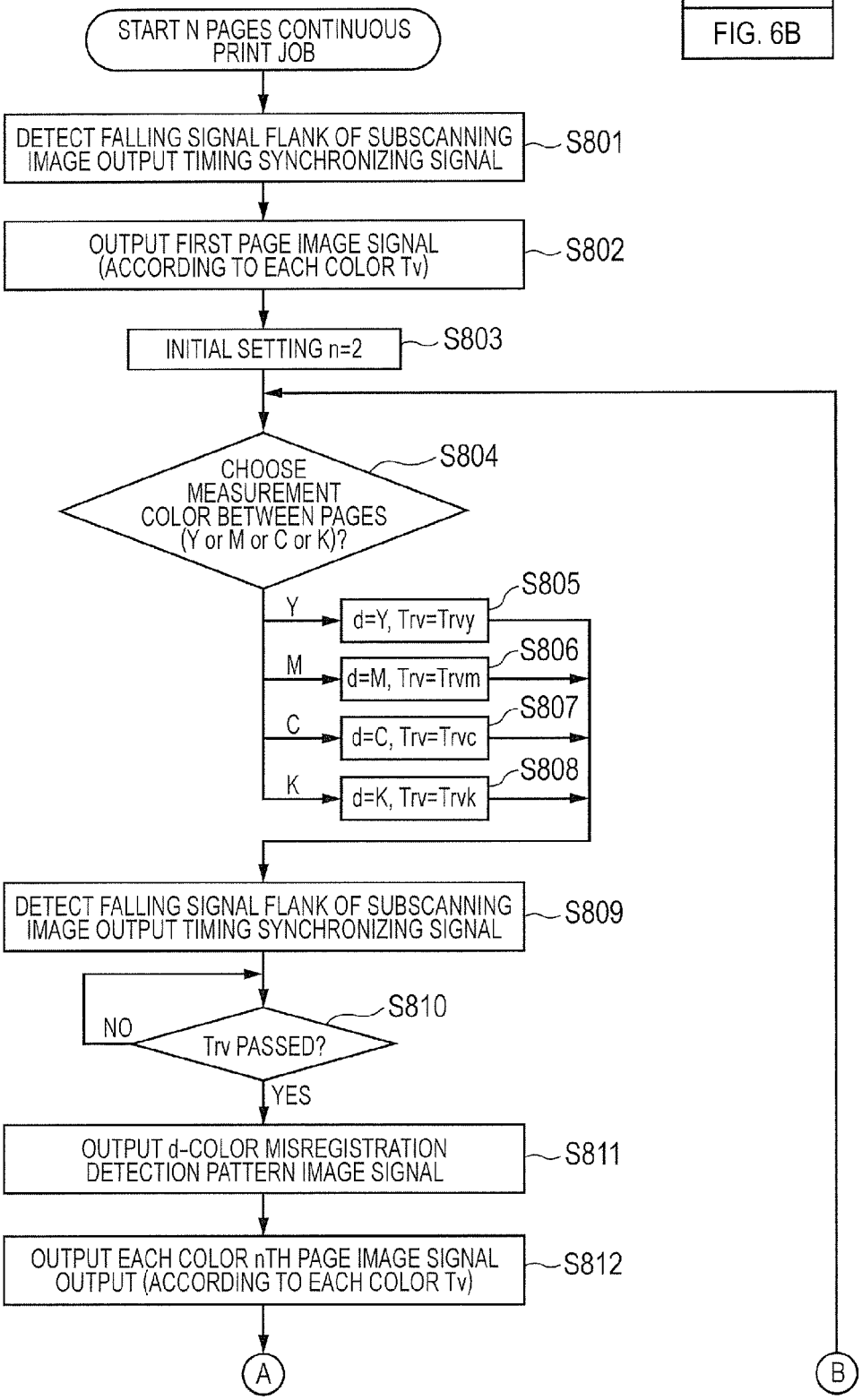
FIG. 6 which consists of FIGS. 6A and 6B are flowcharts of a process of detecting and correcting misregistration in Embodiment 2.
Figure 6B:
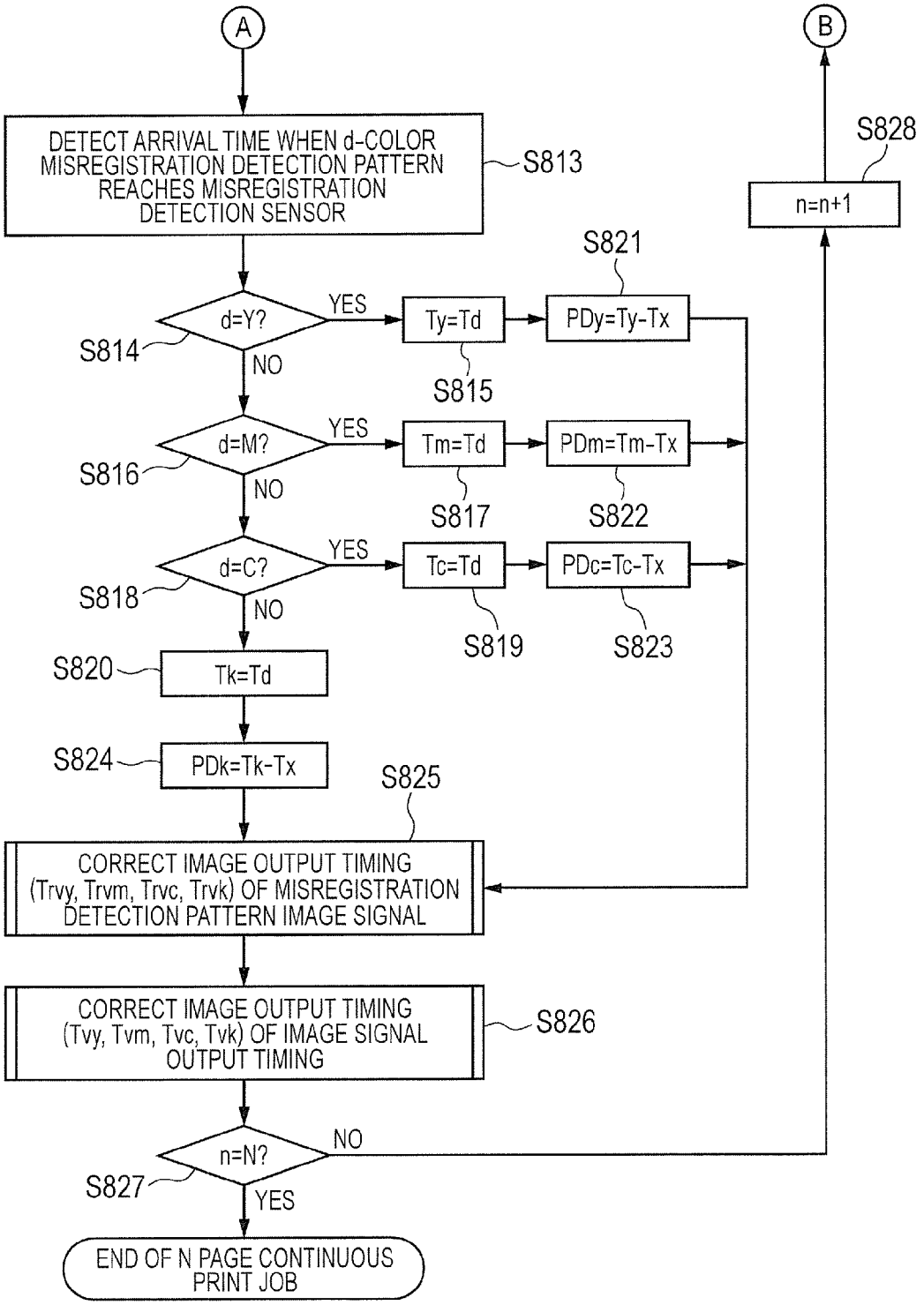

The flow of the method of detecting and correcting misregistration between pages in this embodiment is identical to the flowcharts in FIGS. 6A and 6B described in Embodiment 2. Accordingly, the description thereof is omitted. In this embodiment, (Equation 32) to (Equation 35) are used in S821 to S824 in FIGS. 6A and 6B, (Equation 36) to (Equation 39) are used in S825, and (Equation 40) to (Equation 43) are used in S826.

Thus, this embodiment allows the amount of misregistration of each color to be measured and corrected at each sheet interval in calibration at short page intervals, while reducing the misregistration on the initial page, which can reduce the misregistration due to rise in temperature. As described above, according to this embodiment, without widening the page intervals, the pattern image for correcting misregistration between pages can be formed, the misregistration correction process can be executed, and the misregistration due to variation in laser irradiation position accompanying the variation in temperature can be reduced.

Another Embodiment

The present invention is also applicable to an image forming apparatus that includes a plurality of image forming units, sequentially transfers toner images on a transfer material conveyed on a transfer material conveyance belt (on a conveyance member) to form a full color image. In the case of such an image forming apparatus, the misregistration detection pattern is formed on the surface of the transfer material conveyance belt between the transfer materials held on the transfer material conveyance belt, and the misregistration detection pattern is detected by the misregistration detection sensor.

As described above, according to another embodiment, the pattern image for correcting the misregistration is formed between pages without widening the page intervals, and the misregistration correction process is executed, which can reduce misregistration due to variation in laser irradiation position accompanying variation in temperature.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-263536, filed Dec. 1, 2011, and No. 2012-207123, filed Sep. 20, 2012 which are hereby incorporated by reference herein in their entirety.

What is claimed is:

1. An image forming apparatus, comprising:

a plurality of image forming devices, each including a developing device that develops an electrostatic latent image formed on an image bearing member to form a toner image, and a transferring device that transfers the toner image developed by the developing device to an intermediate transfer member or a transfer material conveyed by a transfer material conveyance member, for each of a plurality of colors;

an exposure unit that irradiates the image bearing members with a laser beam to form the electrostatic latent image on the image bearing members;

a detector that detects an image pattern for correcting misregistration of each color, the image pattern formed on the intermediate transfer member or the conveyed transfer material; and a control device that corrects the misregistration of each color based on a detection result by the detector, wherein the control device performs control to form an image pattern of at least one color among the plurality of colors but not all of the plurality of colors on a first page interval in an image forming area that is between a first image and a second image formed subsequently to the first image, and corrects misregistration based on a first period from a timing when a reference signal to form the image pattern of the at least one color among the plurality of colors is transmitted to a timing when the image pattern of the at least one color among the plurality of colors is detected by the detector, wherein the control device performs control to form an image pattern of another color different from the at least one color among the plurality of colors on a second page interval different from the first page interval, and corrects misregistration based on the first period and a second period from a timing when a reference signal to form the image pattern of the other color is transmitted to a timing when the image pattern of the other color is detected by the detector.

2. An image forming apparatus according to claim 1, wherein the control device performs control to form an image pattern of a single color among the plurality of colors on the first page interval, and corrects misregistrations of the plurality of colors based on a reference period from a timing when a reference signal to form the image pattern of the single color among the plurality of colors is transmitted to a timing when the image pattern of the single color among the plurality of colors is detected by the detector.

3. An image forming apparatus according to claim 2, wherein the control device performs control to form a reference pattern of a plurality of colors for obtaining the reference period for correcting the misregistration before the first image is formed, obtains the reference period for correcting the misregistration from a detection result of the reference pattern of the plurality of colors, and corrects the misregistration based on the first period and the reference period.

4. An image forming apparatus according to claim 1, wherein the control device performs control to form an image pattern of only one color among the plurality of colors, on the first page interval.

5. An image forming apparatus according to claim 1, wherein the control device performs control to correct a timing when the exposure unit emits a laser beam for correcting misregistration.

6. An image forming apparatus according to claim 1, wherein the control device performs control to correct a timing when the exposure unit emits a laser beam for correcting misregistration.

7. An image forming apparatus, comprising:

a plurality of image forming devices, each including a developing device that develops an electrostatic latent image formed on an image bearing member to form a toner image, and a transferring device that transfers the toner image developed by the developing device on an intermediate transfer member or a transfer material conveyed by a transfer material conveyance member, for each of a plurality of colors;

an exposure unit that irradiates the image bearing members with a laser beam to form the electrostatic latent image on the image bearing members;

a detector that detects an image pattern for correcting misregistration of each color, the image pattern formed on a page between a first image and a second image formed subsequently to the first image on the intermediate transfer member or the conveyed transfer material; and a control device that corrects the misregistration of each color based on a detection result by the detector, wherein the control device performs control to form a reference pattern of a plurality of colors for obtaining a reference period for calculating an amount of the misregistration before the first image is formed, obtains the reference period for calculating the amount of the misregistration by comparing a timing based on a detection result of the reference pattern to a timing based on a detection result of the image pattern for each of the plurality of colors, and corrects the misregistration based on the reference period.

* * * * *